US008465255B2

(12) United States Patent
Hada et al.

(10) Patent No.: US 8,465,255 B2
(45) Date of Patent: Jun. 18, 2013

(54) GAS TURBINE BLADE AND GAS TURBINE HAVING THE SAME

(75) Inventors: Satoshi Hada, Hyogo (JP); Masanori Yuri, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 160 days.

(21) Appl. No.: 12/599,833

(22) PCT Filed: May 12, 2009

(86) PCT No.: PCT/JP2009/058824
§ 371 (c)(1),
(2), (4) Date: Nov. 12, 2009

(87) PCT Pub. No.: WO2009/139374
PCT Pub. Date: Nov. 19, 2009

(65) Prior Publication Data

US 2011/0044822 A1 Feb. 24, 2011

(30) Foreign Application Priority Data

May 14, 2008 (JP) ..... 2008-127702

(51) Int. Cl.
*F01D 5/08* (2006.01)

(52) U.S. Cl.
USPC ..... 416/97 R

(58) Field of Classification Search
USPC ..... 415/115; 416/96 R, 97 R
See application file for complete search history.

(56) References Cited

U.S. PATENT DOCUMENTS

| | | | | |
|---|---|---|---|---|
| 6,126,396 | A | 10/2000 | Doughty et al. | |
| 6,206,638 | B1 * | 3/2001 | Glynn et al. | 416/97 R |
| 7,186,085 | B2 | 3/2007 | Lee | |

FOREIGN PATENT DOCUMENTS

| | | | |
|---|---|---|---|
| CN | 1169175 | A | 12/1997 |
| CN | 1424490 | A | 6/2003 |
| JP | 6-42301 | A | 2/1994 |
| JP | 7189603 | A | 7/1995 |
| JP | 08144704 | A | 6/1996 |
| JP | 11-200893 | A | 7/1996 |
| JP | 2000-213304 | A | 8/2000 |
| JP | 2000230401 | A | 8/2000 |
| JP | 2007292006 | A | 11/2007 |

OTHER PUBLICATIONS

Korean Notice of Allowance dated May 3, 2012 in Korean Application No. 10-2009-7025541.
A JP Office Action, dated Apr. 17, 2012, issued in JP Application No. 2008-127702.
Korean Office Action, Application No. 10-2009-7025541, Nov. 9, 2011.
Office Action as issued on Jan. 5, 2013 for corresponding Chinese Patent Application No. 2009800004103.

* cited by examiner

*Primary Examiner* — Nathaniel Wiehe
*Assistant Examiner* — Adam W Brown
(74) *Attorney, Agent, or Firm* — Kanesaka Berner & Partners, LLP

(57) ABSTRACT

Provided is a gas turbine blade capable of improving the heat-conducting capacity of a serpentine channel. In a gas turbine blade including a serpentine channel in which a plurality of cooling channels, extending from the base end side to the distal end side of the blade, are provided from the leading edge to the trailing edge of the blade, at least two of these cooling channels being connected in a folded manner at the base end or distal end, the serpentine channel is formed such that the channel cross-sectional area becomes sequentially smaller from the cooling channel provided at the extreme upstream side of the serpentine channel to the cooling channel provided at the extreme downstream side.

6 Claims, 3 Drawing Sheets

GAS TURBINE BLADE AND GAS TURBINE HAVING THE SAME

RELATED APPLICATIONS

The present application is a National Phase of PCT/JP2009/058824 filed May 12, 2009, and claims priority from Japanese Application Number 2008-127702 filed May 12, 2009, the disclosures of which are hereby incorporated by reference herein in their entirety.

TECHNICAL FIELD

The present invention relates to a gas turbine blade having a cooling structure.

BACKGROUND ART

In recent years, there has been a trend toward increasing the inlet temperature of combustion gas flowing into gas turbine blades in order to improve gas turbine performance, and it will reach 1700° C. in future. Thus, several cooling structures for gas turbine blades have been developed. One such known cooling structures is a serpentine channel in which a plurality of cooling channels are formed within the blade along the span-wise direction, and these channels are connected at the base end or the tip end of the blade in a folded manner (see PTL 1).

CITATION LIST

Patent Literature

{PTL 1}
Japanese Unexamined Patent Application, Publication No. Hei 8-144704 (see FIG. 1)

SUMMARY OF INVENTION

Technical Problem

There is a problem in that the temperature of the coolant fluid flowing within the serpentine channel is increased due to heat received by cooling the gas turbine blades, and desired cooling performance cannot be exhibited at the downstream side. In one countermeasure that has been taken to overcome this problem, the heat-conducting capacity is increased by providing turbulators within the channel; however, this cannot be considered adequate when future increases of the combustion gas temperature are taken into account.

The present invention has been conceived in light of the circumstances described above, and it provides a gas turbine blade capable of improving the heat-conducting capacity of a serpentine channel and a gas turbine having the same.

Solution to Problem

In order to solve the aforementioned problems, the gas turbine blade of the present invention and the gas turbine having the same employ the following solutions.

Namely, the gas turbine blade according to the present invention includes a serpentine channel in which a plurality of cooling channels, extending from the base end to the tip end of the blade, are provided from the leading edge to the trailing edge of the blade, at least two of these cooling channels being connected in a folded manner at the base end or the tip end, wherein the serpentine channel is formed such that the channel cross-sectional area becomes sequentially smaller from the cooling channel at the extreme upstream side of the serpentine channel to the cooling channel at the extreme downstream side.

Since the channel cross-sectional areas of the cooling channels constituting the serpentine channel are formed so as to become sequentially smaller from the extreme upstream side to the extreme downstream side, the flow rate of the coolant fluid increases as it flows downstream. Therefore, the reduction of the heat-conducting capacity can be compensated for by the increased flow rate even if the temperature of the coolant fluid is increased as it flows downstream.

The gas turbine blade of the present invention may be configured such that the gas turbine blade includes a first wall portion that partitions a first cooling channel located at the leading edge side and a second cooling channel located adjacent to the trailing edge side of the first cooling channel; a second wall portion that partitions the second cooling channel and a third cooling channel located adjacent to the trailing edge side of the second cooling channel; and a third wall portion that partitions the third cooling channel and a fourth cooling channel located adjacent to the trailing edge side of the third cooling channel; wherein the serpentine channel is formed by the second to fourth cooling channels such that the second cooling channel is provided at the extreme downstream side; the first wall portion and the third wall portion are arranged such that the distance therebetween becomes greater from the pressure side towards the suction side of the blade; the second wall portion extends substantially parallel to the third wall portion; the second channel, having a substantially triangular lateral cross-section, is formed by the first wall portion, the second wall portion, and the suction side wall portion of the blade; and the third channel, having a substantially square lateral cross-section, is formed by the second wall portion, the suction side wall portion of the blade, the third wall portion, and the pressure side wall portion of the blade.

According to this configuration, since the first wall portion and the third wall portion are arranged such that the distance therebetween becomes greater from the pressure side towards the suction side of the blade, the lateral cross-sectional shape formed by the first wall portion, the third wall portion, the pressure side wall portion of the blade, and the suction side wall portion of the blade becomes substantially a trapezoid in which the pressure side wall portion of the blade is a short side, the suction side wall portion of the blade is a long side, and the first wall portion and the third wall portion are oblique sides. This trapezoid is divided into a triangle shape and a square shape by the second wall portion that extends parallel to the third wall portion. Accordingly, by using the pressure side wall portion of the blade, which becomes the short side of the trapezoid, as one side of the square, it is possible to achieve a square shape that, as much as possible, does not become flat. Therefore, the heat-conducting surface area of the pressure side wall portion can be made larger, thereby increasing the cooling capacity of the blade.

The gas turbine blade of the present invention may be configured such that the second wall portion is not connected to the pressure side wall portion of the blade but is connected to the first wall portion.

According to this configuration, since the second wall portion is not connected to the pressure side wall portion of the blade but is connected to the first wall portion, the pressure side wall portion of the blade is prevented from being covered by the wall thickness of the second wall portion. Therefore, a heat-conducting surface area with which the pressure side wall portion of the blade contacts directly with the coolant fluid without being obstructed by the second wall portion can be ensured, and the cooling capacity is increased.

The gas turbine blade of present invention may be configured such that the gas turbine blade includes a first wall portion that partitions a first cooling channel located at the leading edge side and a second cooling channel located adjacent to the trailing edge side of the first cooling channel; a second wall portion that partitions the second cooling channel and a third cooling channel located adjacent to the trailing edge side of the second cooling channel; and a third wall portion that partitions the third cooling channel and a fourth cooling channel located adjacent to the trailing edge side of the third cooling channel; wherein the serpentine channel is formed by the second to fourth cooling channels such that the second cooling channel is provided at the extreme downstream side; the first wall portion and the third wall portion are arranged such that the distance therebetween becomes greater from the pressure side towards the suction side of the blade; the second wall portion extends substantially parallel to the second wall portion; the second channel, having a substantially square lateral cross-section, is formed by the first wall portion, the suction side wall portion of the blade, the second wall portion, and the pressure side wall portion of the blade; and the third channel, having a substantially triangular lateral cross-section, is formed by the second wall portion, the pressure side wall portion of the blade, and the third wall portion.

According to this configuration, since the first wall portion and the third wall portion are arranged such that the distance therebetween becomes greater from the pressure side towards the suction side of the blade, the lateral cross-sectional shape formed by the first wall portion, the third wall portion, the pressure side wall portion of the blade, and the suction side wall portion of the blade become substantially a trapezoid in which the pressure side wall portion of the blade is a short side, the suction side wall portion of the blade is a long side, and the first wall portion and third wall portion are oblique sides. This trapezoid is divided into a square shape and a triangle shape by the second wall portion that extends parallel to the first wall portion. Accordingly, by using the pressure side wall portion of the blade, which becomes the short side of the trapezoid, as one side of the square, it is possible to achieve a square shape that, as much as possible, does not become flat. Accordingly, the heat-conducting surface area of the pressure side wall portion can be made larger, thereby increasing the cooling capacity of the blade.

The gas turbine blade of the present invention may be configured such that the second wall portion is connected to the third wall portion but is not connected to the pressure side wall portion of the blade.

According to this configuration, since the second wall portion is not connected to the pressure side wall portion of the blade but is connected to the third wall portion, the pressure side wall portion of the blade is prevented from being covered by the wall thickness of the second wall portion. Therefore, a heat-conducting surface area with which the pressure side wall portion of the blade contacts directly with the coolant fluid without being obstructed by the second wall portion can be ensured, and the cooling capacity is increased.

A gas turbine of the present invention may be configured to include any of the above-mentioned gas turbine blades.

According to this configuration, since any of above-mentioned gas turbine blades is included, a gas turbine with superior cooling performance can be provided.

Advantageous Effects of Invention

Since the channel cross-sectional areas of the cooling channels constituting the serpentine channel are formed so as to become sequentially smaller from the extreme upstream side to the extreme downstream side, the reduction of the heat conduction can be compensated for by the increased flow rate even when the temperature of the coolant fluid is increased as it flows downstream. Thus, high cooling efficiency can be achieved with a small amount of cooling air that is the minimum amount required.

DESCRIPTION OF EMBODIMENTS

An embodiment according to the present invention will be described below with reference to the drawings.

First Embodiment

Figure 4:
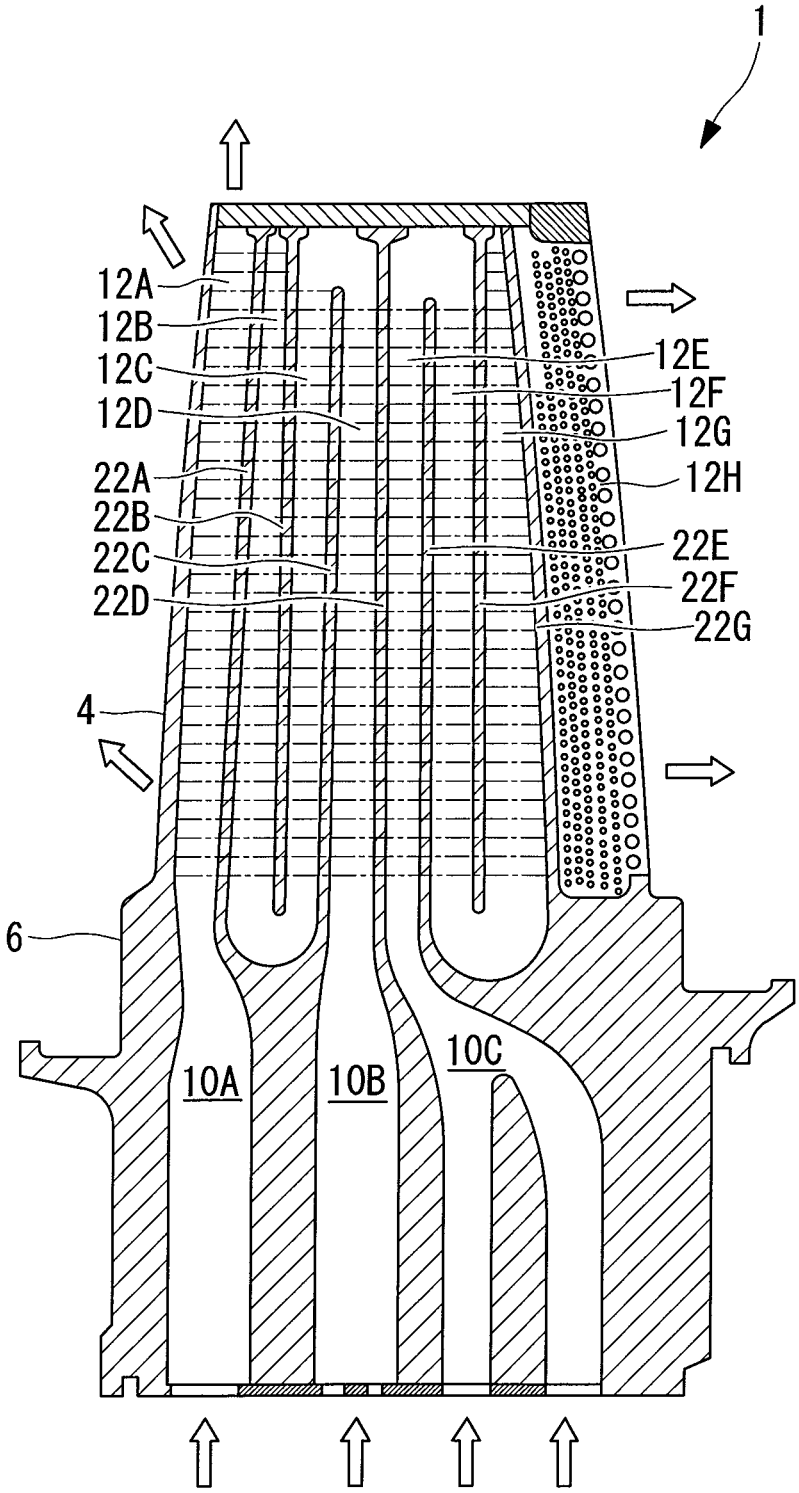
FIG. 4 is a longitudinal-cross-sectional diagram of a gas turbine blade according to one embodiment of the present invention.

FIG. 4 shows a longitudinal-cross-section of a gas turbine blade according to this embodiment.

The gas turbine blade 1 shown in this figure is one suitably used as a rotor blade. The gas turbine blade 1 is provided with a base portion 6 that forms a platform and a blade portion 4 that is provided so as to stand upright (radial direction) on the base portion 6, and forms the profile of the blade.

The base portion 6 is provided with a first air introduction channel 10A, a second air introduction channel 10B, and a third air introduction channel 10C into which cooling air, which is coolant fluid, is introduced. As the cooling air, part of air compressed by a compressor for compressing combustion air is used.

A plurality of cooling channels extending in the span-wise direction of the blade are formed in the blade portion 4, and a first cooling channel 12A, a second cooling channel 12B, a third cooling channel 12C, a fourth cooling channel 12D, a fifth cooling channel 12E, a sixth cooling channel 12F, a seventh cooling channel 12G, and an eighth cooling channel 12H are formed from the leading edge towards the trailing edge of the blade.

The first cooling channel 12A is connected to the first air introduction channel 10A. The cooling air introduced from the first air introduction channel 10A flows from the bottom toward the top (outwards in the radial direction) within the first cooling channel 12A, flows to the outside through the film cooling holes (not shown), and cools the outer surface of the blade.

The second to fourth cooling channels 12B, 12C, and 12D form a series of serpentine channels. In other words, they are connected such that the fourth cooling channel 12D is provided at the extreme upstream side, the third cooling channel 12C is provided at the downstream side thereof, and the second cooling channel 12B is provided at the extreme downstream side. The fourth cooling channel 12D and the third cooling channel 12C are connected at the distal end of the blade in a folded manner. Furthermore, the third cooling channel 12C and the second cooling channel 12B are connected at the base end of the blade in a folded manner. The second air introduction channel 10B is connected to the fourth cooling channel 12D, and the cooling air introduced from the second air introduction channel 10B flows through the fourth cooling channel 12D, the third cooling channel 12C, and the second cooling channel 12B in this order. The cooling air that has flowed to the second cooling channel 12B then flows to the outside through film cooling holes (not shown) and cools the outer surface of the blade.

The fifth to seventh cooling channels 12E, 12F, and 12G form a series of serpentine channels. In other words, they are connected such that the fifth cooling channel 12E is provided at the extreme upstream side, the sixth cooling channel 12F is provided downstream thereof, and the seventh cooling channel 12G is provided at the extreme downstream side. The fifth cooling channel 12E and the sixth cooling channel 12F are connected at the distal end of the blade in a folded manner. Furthermore, the sixth cooling channel 12F and the seventh cooling channel 12G are connected at the base end of the blade in a folded manner. The third air introduction channel 10C is connected to the fifth cooling channel 12E, and the cooling air introduced from the third air introduction channel 10C flows through the fifth cooling channel 12E, the sixth cooling channel 12F, and the seventh cooling channel 12G in this order. The cooling air that has flowed to the seventh cooling channel 12G flows to the outside through film cooling holes (not shown) and cools the outer surface of the blade.

The cooling air is introduced into the eighth cooling channel 12H from an air introduction channel, which is not shown. The introduced cooling air flows upwards (outwards in the radial direction) within the eighth cooling channel 12H and flows to the outside from the trailing edge of the blade.

Figure 1:
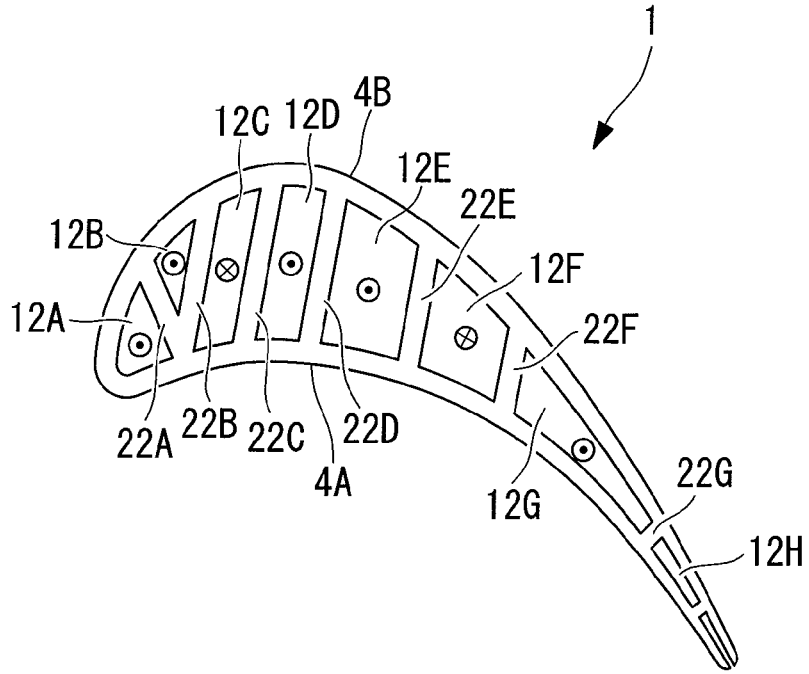
FIG. 1 is a cross-sectional diagram of a gas turbine blade according to a first embodiment of the present invention.

FIG. 1 shows a lateral cross-section of the gas turbine blade 1. Of the symbols shown in the each of the cooling channels 12 in this figure, a symbol having a solid point inside a circle means that the cooling air flows outwards in the radial direction (from the bottom toward the top in FIG. 4) within the channel, and a symbol having an x mark inside a circle means that the cooling air flows inwards in the radial direction (from the top toward the bottom in FIG. 4) within the channel.

As shown in this figure, the first cooling channel 12A and the second cooling channel 12B are partitioned by a first wall portion 22A. Similarly, the second cooling channel 12B and the third cooling channel 12C, the third cooling channel 12C and the fourth cooling channel 12D, the fourth cooling channel 12D and the fifth cooling channel 12E, the fifth cooling channel 12E and the sixth cooling channel 12F, the sixth cooling channel 12F and the seventh cooling channel 12G, and the seventh cooling channel 12G and the eighth cooling channel 12H are partitioned by a second wall portion 22B, a third wall portion 22C, a fourth wall portion 22D, a fifth wall portion 22E, a sixth wall portion 22F, and a seventh wall portion 22G, respectively.

The serpentine channel formed by the second to fourth cooling channels 12B, 12C, and 12D is formed such that the channel cross-sectional area becomes sequentially smaller along the direction of flow of the cooling air. In other words, the channel cross-sectional area of the third cooling channel 12C provided downstream of the fourth cooling channel 12D that is provided at the extreme upstream side is made smaller than this fourth cooling channel 12D, and the channel cross-sectional area of the second cooling channel 12B provided downstream of the third cooling channel 12C is made smaller than this third cooling channel 12C.

Furthermore, also with respect to the serpentine channel formed by the fifth to the seventh cooling channels 12E, 12F, and 12G, the channel cross-sectional area is formed so as to become sequentially smaller along the direction of flow of the cooling air. In other words, the channel cross-sectional area of the sixth cooling channel 12F provided downstream of the fifth cooling channel 12E that is provided at the extreme upstream side is made smaller than this fifth cooling channel 12E, and the channel cross-sectional area of the seventh cooling channel 12G provided downstream of the sixth cooling channel 12F is made smaller than this sixth cooling channel 12F.

By making the channel cross-sectional areas of the cooling channels that constitute the serpentine channel become sequentially smaller from the extreme upstream side to the extreme downstream side in this way, the following effects and advantages are afforded.

Since the cooling air picks up heat by cooling the blade and the temperature thereof is increased as it flows in the serpentine channel, the cooling capacity is reduced. In this embodiment, since the channel cross-sectional area of the serpentine channel is made to become sequentially smaller, the flow rate can be increased as the cooling air flows downstream. Therefore, even though the temperature of the coolant fluid is increased as it flows downstream, the reduction of the heat-conducting capacity can be compensated for by the increased flow rate, and the desired cooling capacity can be achieved.

The first wall portion 22A and the third wall portion 22C are arranged such that the distance therebetween becomes greater from the pressure side wall portion 4A towards the suction side wall portion 4B of the blade. The second wall portion 22B extends substantially parallel to the third wall portion 22C. Thereby, the second channel 12B having a substantially triangular lateral cross-section is formed by the first wall portion 22A, the second wall portion 22B, and the suction side wall portion 4B of the blade. The third channel 12C having a substantially square lateral cross-section is formed by the second wall portion 22B, the suction side wall portion 4B of the blade, the third wall portion 22C, and the pressure side wall portion 4A of the blade.

With such a configuration, the following effects and advantages are afforded.

Since the first wall portion 22A and the third wall portion 22C are arranged such that the distance therebetween becomes greater from the pressure side wall portion 4A towards the suction side wall portion 4B of the blade, the lateral cross-sectional shape formed by the first wall portion 22A, the third wall portion 22C, the pressure side wall portion 4A of the blade, and the suction side wall portion 4B of the blade becomes substantially a trapezoid in which the pressure side wall portion 4A of the blade is a short side, the suction side wall portion 4B of the blade is a long side, and the first wall portion 22A and the third wall portion 22C are oblique sides. This trapezoid is divided into a triangle shape and a square shape by the second wall portion 22B that extends parallel to the third wall portion 22C. Accordingly, by using the pressure side wall portion 4A of the blade, which becomes the short side of the trapezoid, as one side of the square, it is possible to achieve a square shape that, as much as possible, does not become flat. Therefore, the heat-conducting surface area of the pressure side wall portion 4A can be made larger, thereby increasing the cooling capacity of the blade.

Furthermore, the second wall portion 22B is not connected to the pressure side wall portion 4A of the blade but is connected to the first wall portion 22A. The effects and advantages afforded thereby are as follows.

If the second wall portion 22B were connected to the pressure side wall portion 4A of the blade, and the pressure side wall portion 4A of the blade were covered by the wall thickness of the second wall portion 22B, this covered portion would act as an obstruction, and the cooling air would not be able to come into direct contact with the pressure side wall portion 4A of the blade; thus, there is a possibility that the cooling would be insufficient. Therefore, in this embodiment, by connecting the second wall portion 22B to the first wall portion 22A but not to the pressure side wall portion 4A of the blade, the pressure side wall portion 4A of the blade is prevented from being covered by the wall thickness of the second wall portion 22B. Accordingly, a heat-conducting surface area with which the pressure side wall portion 4A of the blade contacts directly with the coolant fluid without being obstructed by the second wall portion 22B can be ensured, and the cooling capacity is increased.

In this embodiment, the fourth to sixth wall portions 22D, 22E, and 22F are also provided substantially parallel to the third wall portion 22C. This is because an advantage is afforded in that a core for forming a cooling channel that is used for casting the gas turbine blade 1 can be drawn in the same direction upon production thereof.

Second Embodiment

Figure 2:
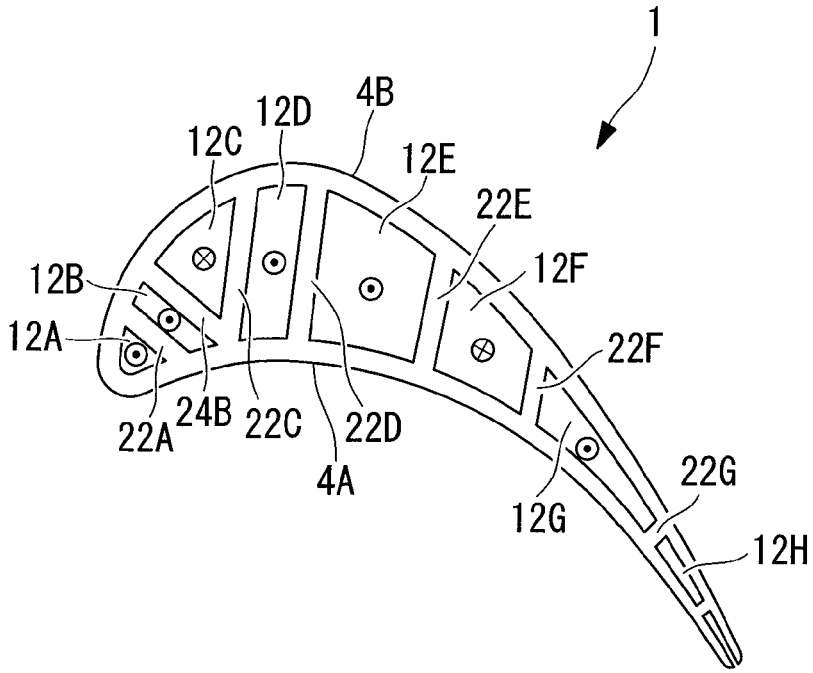
FIG. 2 is a cross-sectional diagram of a gas turbine blade according to a second embodiment of the present invention.

Next, a second embodiment of the present invention will be described with reference to FIG. 2. This embodiment differs from the first embodiment in that the extension direction of a second wall portion 24B is different, and the other structures are the same. Therefore, in the following, only the differences are described, and with respect to the others, similar effects and advantages are afforded.

The second wall portion 22B extends substantially parallel to the first wall portion 22A. Accordingly, a second channel 12B having a substantially square lateral cross-section is formed by the first wall portion 22A, the suction side wall portion 4B of the blade, the second wall portion 22B, and the pressure side wall portion 4A of the blade. A third channel 12C having a substantially triangular lateral cross-section is formed by the second wall portion 22B, the suction side wall portion 4B of the blade, and the third wall portion 22C.

With such a configuration, the following effects and advantages are afforded.

Since the first wall portion 22A and the third wall portion 22C are arranged such that the distance therebetween becomes greater from the pressure side wall portion 4A towards the suction side wall portion 4B of the blade, the lateral cross-sectional shape formed by the first wall portion 22A, the third wall portion 22C, the pressure side wall portion 4A of the blade, and the suction side wall portion 4B of the blade becomes substantially a trapezoid in which the pressure side wall portion 4A of the blade is the short side, the suction side wall portion 4B of the blade is the long side, and the first wall portion 22A and third wall portion 22C are the oblique sides. This trapezoid is divided into a square shape and a triangle shape by the second wall portion 22B that extends parallel to the first wall portion 22A. Accordingly, by using the pressure side wall portion 4A of the blade, which becomes the short side of the trapezoid, as one side of the square, it is possible to achieve a square shape that, as much as possible, does not become flat. Therefore, the heat-conducting surface area of the pressure side wall portion 4A can be made larger, thereby increasing the cooling capacity of the blade.

Furthermore, the second wall portion 22B is not connected to the pressure side wall portion 4A of the blade but is connected to the third wall portion 22C. The effects and advantages afforded thereby are as follows.

If the second wall portion 22B were connected to the pressure side wall portion 4A of the blade, and the pressure side wall portion 4A of the blade were covered by the wall thickness of the second wall portion 22B, this covered portion would act as an obstruction, and the cooling air would not be able to come into direct contact with the pressure side wall portion 4A of the blade; thus, there is a possibility that the cooling would be insufficient. Therefore, in this embodiment, by connecting the second wall portion 22B to the third wall portion 22C but not to the pressure side wall portion 4A of the blade, the pressure side wall portion 4A of the blade is prevented from being covered by the wall thickness of the second wall portion 22B. Accordingly, a heat-conducting surface area with which the pressure side wall portion 4A of the blade contacts directly with the coolant fluid without being obstructed by the second wall portion 22B can be ensured, and the cooling capacity is increased.

Third Embodiment

Figure 3:
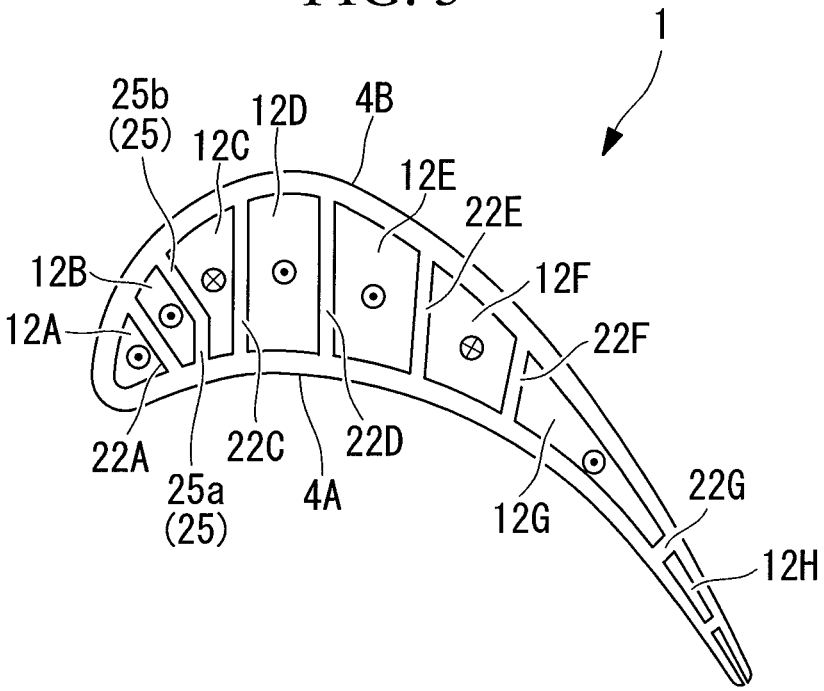
FIG. 3 is a cross-sectional diagram of a gas turbine blade according to a third embodiment of the present invention.

Next, a third embodiment of the present invention will be described with reference to FIG. 3. This embodiment differs from the first embodiment and the second embodiment in that the shape of the second wall portion is different, and the other structures are the same. Therefore, in the following, only the differences are described, and with respect to the others, similar effects and advantages are afforded. Note that in this embodiment, unlike the first embodiment and the second embodiment, the second cooling channel or the third cooling channel is not divided into the triangle shape or the square shape by the second wall portion. Therefore, the effects and advantages derived from these configurations are not afforded.

The second wall portion 25 is in a bent shape. In other words, a pressure side portion 25*a* of the second wall portion 25 is formed parallel to the third wall portion 22C, and a suction side portion 25*b* of the second wall portion 25 is formed parallel to the first wall portion 22A. By forming the second wall portion 25 in a bent manner in this way, the channel cross-sectional area ratio between the second cooling channel 12B and the third cooling channel 12C constituting the serpentine channel can be adjusted.

Furthermore, in this embodiment, similarly to the first embodiment and the second embodiment, since the channel cross-sectional area of the serpentine channel constituted by the second to the fourth cooling channels 12B, 12C, and 12D and the channel cross-sectional area of the serpentine channel configured by the fifth to seventh cooling channels 12E, 12F, and 12G are formed so as to become sequentially smaller from the extreme upstream side toward the extreme downstream side, the flow rate of the cooling air can be increased as it flows downstream, and the reduction of the heat conduction can be compensated for by the increased flow rate even when the temperature of the coolant fluid is increased as it flows downstream; therefore, the desired cooling capacity can be achieved.

REFERENCE SIGNS LIST

1: gas turbine blade
4: blade portion
6: base portion
12A: first cooling channel
12B: second cooling channel
12C: third cooling channel
12D: fourth cooling channel
22A: first wall portion
22B: second wall portion
22C: third wall portion

The invention claimed is:

1. A gas turbine blade comprising a serpentine channel in which a plurality of cooling channels, extending from the base end to the distal end of the blade, are provided from the leading edge to the trailing edge of the blade, at least two of these cooling channels being connected in a folded manner at the base end or the distal end, a first wall portion that partitions a first cooling channel located at the leading edge side and a second cooling channel located adjacent to the trailing edge side of the first cooling channel;

a second wall portion that partitions the second cooling channel and a third cooling channel located adjacent to the trailing edge side of the second cooling channel; and a third wall portion that partitions the third cooling channel and a fourth cooling channel located adjacent to the trailing edge side of the third cooling channel;

wherein the serpentine channel is formed by the second to fourth cooling channels such that the second cooling channel is provided at the extreme downstream side;

the first wall portion and the third wall portion are arranged such that the distance therebetween becomes greater from the pressure side towards the suction side of the blade;

the second wall portion extends substantially parallel to the third wall portion;

the second channel, having a substantially triangular lateral cross-section, is formed by the first wall portion, the second wall portion, and the suction side wall portion of the blade; and the third channel, having a substantially square lateral cross-section, is formed by the second wall portion, the suction side wall portion of the blade, the third wall portion, and the pressure side wall portion of the blade; and wherein the serpentine channel is formed such that the channel cross-sectional area becomes sequentially smaller from the cooling channel at the extreme upstream side of the serpentine channel to the cooling channel at the extreme downstream side.

2. A gas turbine blade according to claim 1, wherein the second wall portion is not connected to the pressure side wall portion of the blade but is connected to the first wall portion.

3. A gas turbine blade comprising:

a serpentine channel in which a plurality of cooling channels, extending from the base end to the distal end of the blade, are provided from the leading edge to the trailing edge of the blade, at least two of these cooling channels being connected in a folded manner at the base end or the distal end, a first wall portion that partitions a first cooling channel located at the leading edge side and a second cooling channel located adjacent to the trailing edge side of the first cooling channel;

a second wall portion that partitions the second cooling channel and a third cooling channel located adjacent to the trailing edge side of the second cooling channel; and a third wall portion that partitions the third cooling channel and a fourth cooling channel located adjacent to the trailing edge side of the third cooling channel;

wherein the serpentine channel is formed by the second to fourth cooling channels such that the second cooling channel is provided at the extreme downstream side;

the first wall portion and the third wall portion are arranged such that the distance therebetween becomes greater from the pressure side towards the suction side of the blade;

the second wall portion extends substantially parallel to the second first wall portion;

the second channel, having a substantially square lateral cross-section, is formed by the first wall portion, the suction side wall portion of the blade, the second wall portion, and the pressure side wall portion of the blade; and the third channel, having a substantially triangular lateral cross-section, is formed by the second wall portion, the suction side wall portion of the blade, and the third wall portion; and wherein the serpentine channel is formed such that the channel cross-sectional area becomes sequentially smaller from the cooling channel at the extreme upstream side of the serpentine channel to the cooling channel at the extreme downstream side.

4. A gas turbine blade according to claim 3, wherein the second wall portion is connected to the third wall portion but is not connected to the pressure side wall portion of the blade.

5. A gas turbine comprising the gas turbine blade of claim 1.

6. A gas turbine comprising the gas turbine blade of claim 3.

* * * * *